US009897094B2

(12) United States Patent
Kang et al.

(10) Patent No.: US 9,897,094 B2
(45) Date of Patent: Feb. 20, 2018

(54) AXIAL FLOW FAN

(71) Applicant: SUNON ELECTRONICS (FOSHAN) CO., LTD., Guangdong (CN)

(72) Inventors: Chia-Wen Kang, Guangdong (CN); Sin-Fu Ni, Guangdong (CN); Shih-Hang Lin, Guangdong (CN)

(73) Assignee: SUNON ELECTRONICS (FOSHAN) CO., LTD., Guangdong (CN)

( * ) Notice: Subject to any disclaimer, the term of this patent is extended or adjusted under 35 U.S.C. 154(b) by 371 days.

(21) Appl. No.: 14/330,372

(22) Filed: Jul. 14, 2014

(65) Prior Publication Data

US 2015/0016989 A1 Jan. 15, 2015

(30) Foreign Application Priority Data

Jul. 15, 2013 (TW) ..... 102125143 A

(51) Int. Cl.
*F04D 19/00* (2006.01)
*F04D 29/64* (2006.01)
(Continued)

(52) U.S. Cl.
CPC ..... *F04D 19/002* (2013.01); *F04D 25/0613* (2013.01); *F04D 29/522* (2013.01); *F04D 29/646* (2013.01)

(58) Field of Classification Search
CPC .. F04D 17/002; F04D 17/007; F04D 25/0613; F04D 29/522; F04D 29/526;
(Continued)

(56) References Cited

U.S. PATENT DOCUMENTS 1,614,091 A * 1/1927 Van Toff ..... F04D 25/082 415/218.1
3,237,849 A * 3/1966 Krell ..... F04D 29/526 219/137 R
(Continued)

FOREIGN PATENT DOCUMENTS

CA 2786396 A1 * 2/2013 ..... F04D 25/08
CN 2258927 Y 8/1997
(Continued)

OTHER PUBLICATIONS

Machine Translation of TW I249007 [retrieved on Sep. 6, 2016]. Retrieved from: Google.*
(Continued)

*Primary Examiner* — Igor Kershteyn
*Assistant Examiner* — Eric Zamora Alvarez
(74) *Attorney, Agent, or Firm* — WPAT, P.C., Intellectual Property Attorneys; Anthony King

(57) ABSTRACT

An axial flow fan is provided. The axial flow fan includes an impeller and a fan frame. The impeller has a maximum outer diameter. The fan frame includes a first body and a second body. The first body includes a plurality of connecting elements and a base. The connecting elements are connected to the base. The second body is a hollow body, and used for disposing around the impeller. The second body includes a flow passage having a minimum inner diameter. The minimum inner diameter of the flow passage is not larger than the maximum outer diameter of the impeller. Therefore, the size of the second body does not restrict the maximum outer diameter of the impeller, and the shape of the impeller and the shape of the fan frame can be designed flexibly according to the practical demand.

8 Claims, 5 Drawing Sheets

(51) Int. Cl.
*F04D 25/06* (2006.01)
*F04D 29/52* (2006.01)

(58) Field of Classification Search
CPC .... F04D 29/545; F04D 29/547; F04D 29/646; F04D 25/08
USPC ..... 361/695; 416/198 R
See application file for complete search history.

(56) References Cited

U.S. PATENT DOCUMENTS 4,564,335 A * 1/1986 Harmsen ..... F04D 25/0613 415/218.1
4,618,315 A 10/1986 Papst et al.
4,909,711 A 3/1990 Burgbacher et al.
5,695,318 A 12/1997 Harmsen
6,549,406 B1 * 4/2003 Olesiewicz ..... H05K 7/20581 165/80.3
7,040,862 B2 * 5/2006 Otsuka ..... F04D 29/542 29/888.02
7,494,408 B2 * 2/2009 Chen ..... H05K 7/20172 361/695
7,654,792 B2 2/2010 Kikuichi et al.
7,997,859 B2 * 8/2011 Li ..... F04D 29/542 415/175
8,123,461 B2 2/2012 Yoshida
8,133,006 B2 3/2012 Yoshica
2004/0253128 A1 * 12/2004 Cheng ..... F04D 29/526 417/423.9
2005/0260063 A1 * 11/2005 Blateri ..... F04D 29/646 415/1
2007/0189892 A1 * 8/2007 Oguma ..... F04D 29/542 415/200
2009/0022587 A1 1/2009 Yoshida et al.
2010/0329860 A1 * 12/2010 Li ..... F04D 19/007 415/213.1
2013/0004293 A1 * 1/2013 Zhao ..... F04D 25/0613 415/66
2013/0108436 A1 * 5/2013 He ..... F04D 29/60 415/213.1
2013/0209294 A1 * 8/2013 Iwamoto ..... F04D 25/08 417/423.14

FOREIGN PATENT DOCUMENTS

CN 201144877 Y 11/2008
TW M261747 4/2005
TW I249007 2/2006

OTHER PUBLICATIONS

Office Action and the Search Report dated Jul. 14, 2015 by Taiwan Patent Office for the corresponding Taiwan Patent Application No. 102125143.
English translation of the Search Report dated Jul. 14, 2015 by Taiwan Patent Office for the corresponding Taiwan Patent Application No. 102125143.
English abstract translation of TWI249007.
English abstract translation of TW M261747.
Office Action dated Nov. 14, 2016 by SIPO for the corresponding Chinese Patent Application No. 201310561565.2.
Search Report dated Nov. 14, 2016 by SIPO for the corresponding Chinese Patent Application No. 201310561565.2.
English translation of the Search Report dated Nov. 14, 2016 by SIPO for the corresponding Chinese Patent Application No. 201310561565.2.
English abstract translation of CN2258927Y.
English abstract translation of CN201144877Y.

* cited by examiner

AXIAL FLOW FAN

TECHNICAL FIELD

The present disclosure is related to a fan, and more particularly, to an axial flow fan.

BACKGROUND

When the conventional axial flow fan is assembled, the impeller is mounted in the housing via an opening of the housing. Thus, a maximum outer diameter of the impeller cannot be larger than an inner diameter of the opening. Such structure limits the size of the maximum outer diameter of the impeller and the inner diameter of the opening, the shape of the impeller and the shape of the housing cannot be designed flexibly to suit the practical demand.

SUMMARY OF THE INVENTION

The present invention provides an axial flow fan. The axial flow fan includes an impeller and a fan frame. The impeller has a maximum outer diameter. The fan frame includes a first body and a second body. The first body includes a plurality of connecting elements and a base. The connecting elements are connected to the base. The second body is a hollow body, and used for disposing around the impeller. The second body includes a flow passage having a minimum inner diameter. The minimum inner diameter of the flow passage is not larger than the maximum outer diameter of the impeller.

The axial flow fan of the invention utilizes the first body and the second body to combine to form the fan frame so that the minimum inner diameter of the flow passage is not larger than the maximum outer diameter of the impeller. Therefore, the size of the second body does not restrict the maximum outer diameter of the impeller, and the shape of the impeller and the shape of the fan frame can be designed flexibly according to the practical demand. Furthermore, using a first combining portion and a second combining portion, the first body and the second body can be combined or disassembled.

BRIEF DESCRIPTION OF THE DRAWINGS

The details of one or more embodiments of the disclosure are set forth in the accompanying drawings and the description below. Other features and advantages of the disclosure will be apparent from the description, drawings and claims.

Like reference symbols in the various drawings indicate like elements.

DETAIL DESCRIPTION

Figure 1:
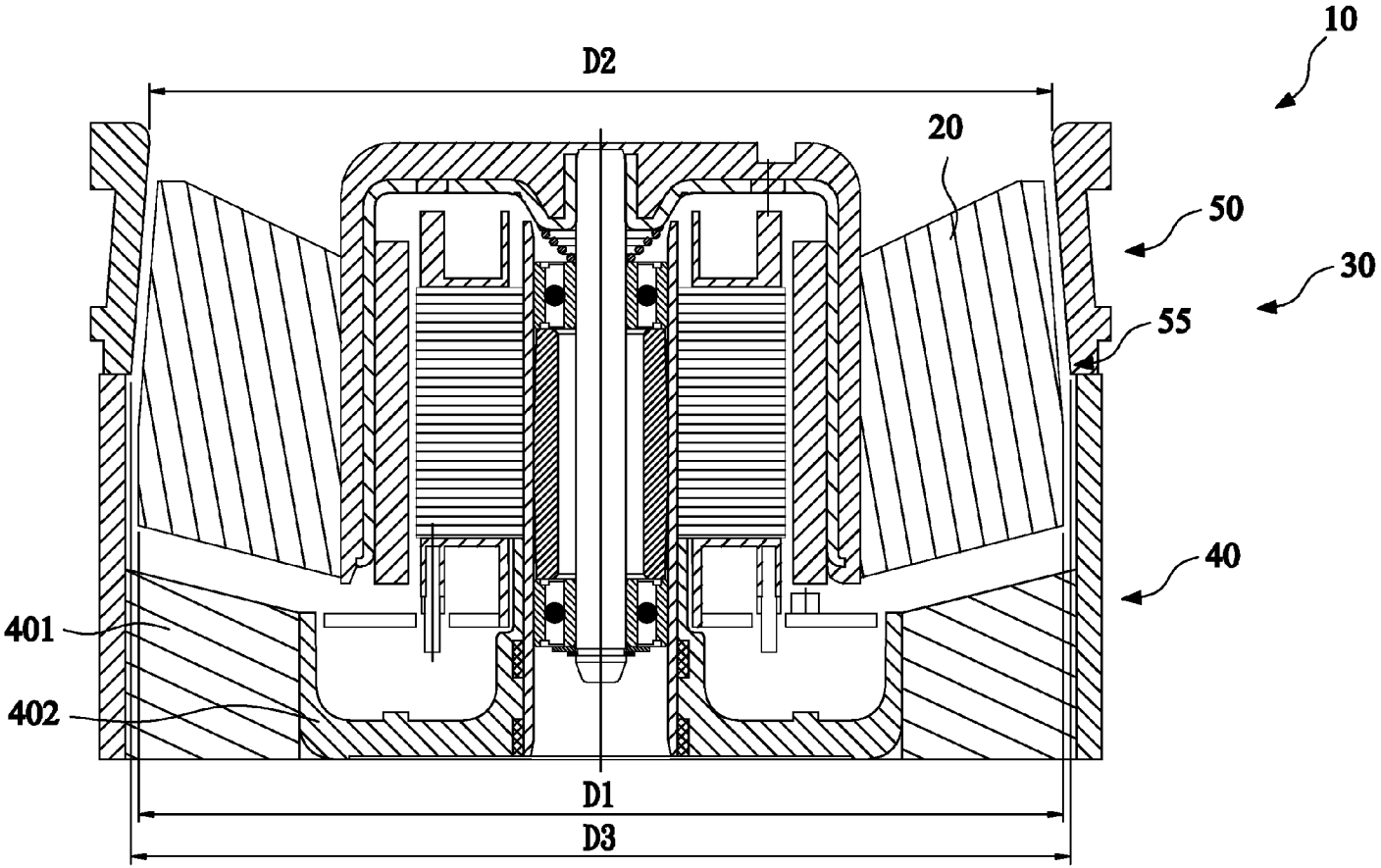
FIG. 1 is a cross-sectional view of an axial flow fan in accordance with some embodiments.
Figure 2:
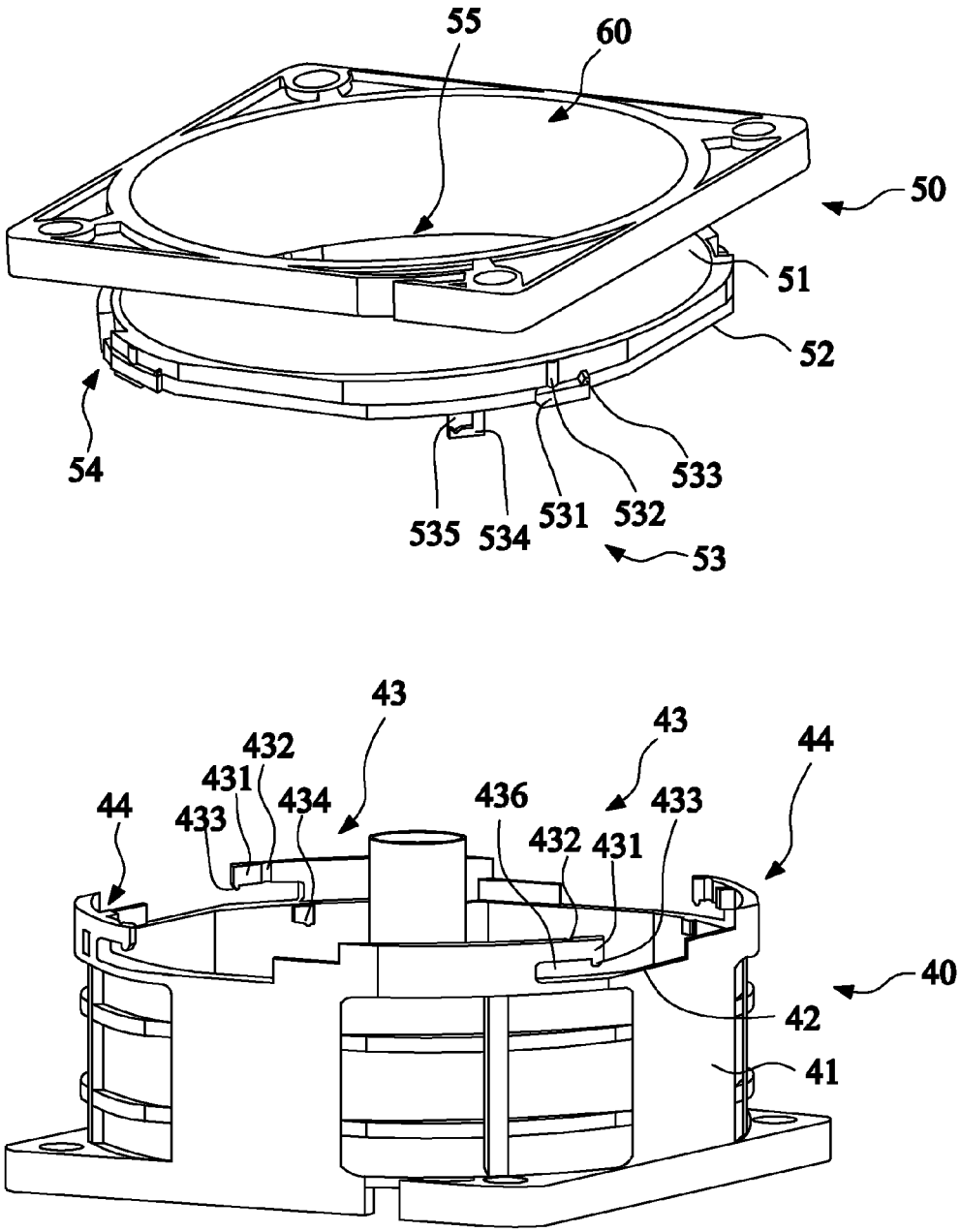
FIG. 2 is an exploded perspective view of a fan frame from a first view angle in accordance with some embodiments.
Figure 3:
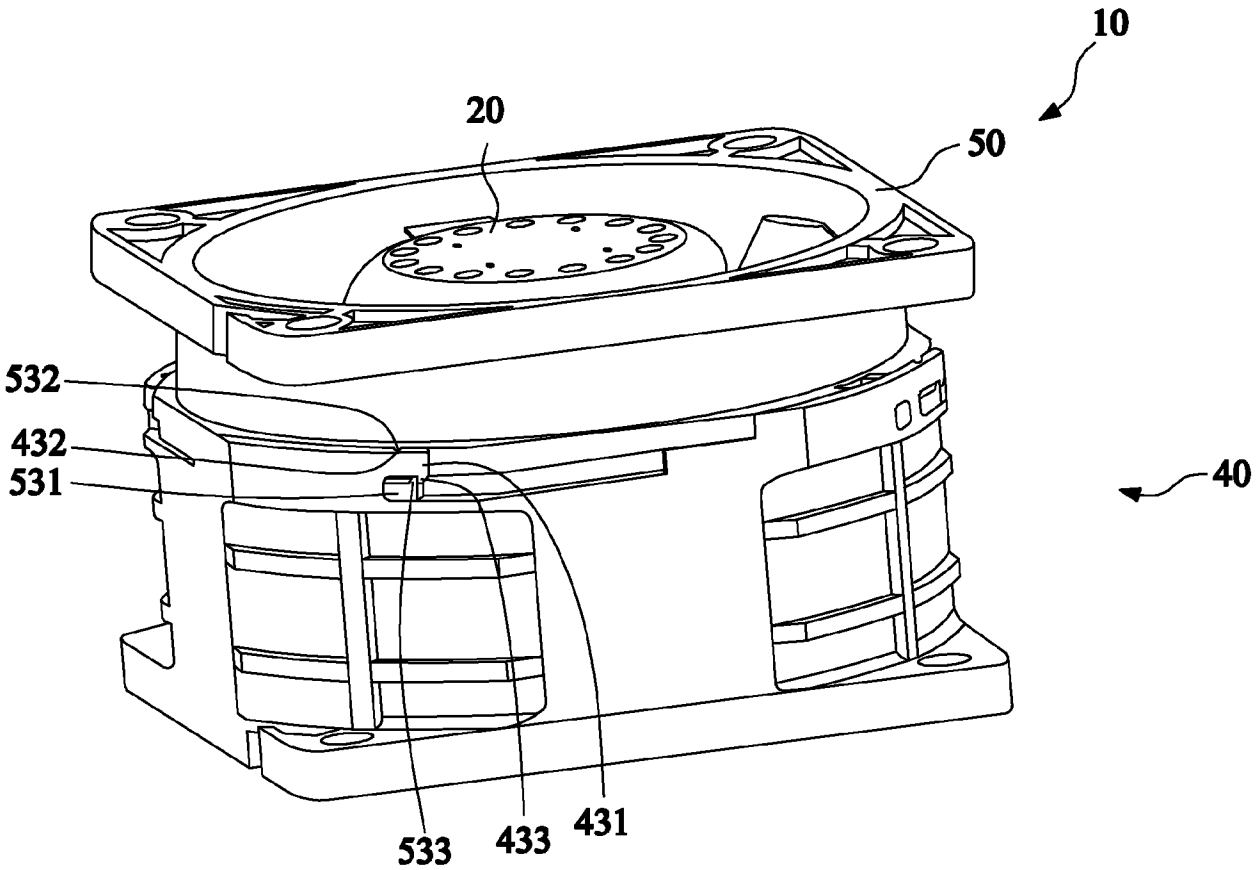
FIG. 3 is a combined perspective view of an axial flow fan from a first view angle in accordance with some embodiments.

FIG. 1 is a cross-sectional view of an axial flow fan in accordance with some embodiments. FIG. 2 is an exploded perspective view of a fan frame from a first view angle in accordance with some embodiments. FIG. 3 is a combined perspective view of an axial flow fan from a first view angle in accordance with some embodiments. Referring to FIG. 1, FIG. 2 and FIG. 3, in an embodiment, the axial flow fan 10 includes an impeller 20 and a fan frame 30. The impeller 20 has a maximum outer diameter D1. In an embodiment, the impeller 20 is a narrow structure on the top and a wide structure on the bottom. The fan frame 30 includes a first body 40 and a second body 50. The first body 40 includes a plurality of connecting elements 401 and a base 402. The connecting elements 401 are connected to the base 402. In an embodiment, the connecting elements 401 can be static blades or connecting ribs. The second body 50 is a hollow body, and used for disposing around the impeller 20. The second body 50 includes a flow passage 60 having a minimum inner diameter D2. The minimum inner diameter D2 of the flow passage 60 is not larger than the maximum outer diameter D1 of the impeller 20.

That is, the second body 50 is a narrow structure on the top and a wide structure on the bottom, and the minimum inner diameter D2 is on the top of the second body 50. Because the minimum inner diameter D2 of the flow passage 60 is not larger than the maximum outer diameter D1 of the impeller 20, the impeller 20 cannot be mounted from the top of the second body 50. Thus, the impeller 20 is mounted on the base 402 of the first body 40 firstly, then the second body 50 is mounted around the impeller 20. The second body 50 and the first body 40 combine to form the axial flow fan 10.

The axial flow fan 10 of the invention utilizes the first body 40 and the second body 50 to combine to form the fan frame 30 so that the minimum inner diameter D2 of the flow passage 60 is not larger than the maximum outer diameter D1 of the impeller 20. Therefore, the size of the second body 50 does not restrict the maximum outer diameter D1 of the impeller 20, and the shape of the impeller 20 and the shape of the fan frame 30 can be designed flexibly according to the practical demand.

The first body 40 further includes a first side wall 41, a first edge 42 and at least one first combining portion 43, 44. The first edge 42 is formed on the first side wall 41. The at least one first combining portions 43, 44 are formed on the first edge 42, and extend along the first side wall 41 and the first edge 42. In an embodiment, the first body 40 includes four first combining portions 43, 44. Two first combining portions 43 are the same structures, and two first combining portions 44 are the same structures.

The second body 50 includes a second side wall 51, a second edge 52 and at least one second combining portion 53, 54. The second edge 52 is formed under the second side wall 51. The at least one second combining portions 53, 54 are formed on the second edge 52, and extend along the second side wall 51 and the second edge 52. The disposing places of the at least one second combining portion 53, 54 are corresponding to those of the at least one first combining portion 43, 44 so as to combine the at least one first combining portion 43, 44 and the at least one second combining portion 53, 54, respectively. In an embodiment, the second body 50 includes four second combining portions 53, 54. Two second combining portions 53 are the same structures, and are corresponding to the two first combining portions 43. Two second combining portions 54 are the same structures, and are corresponding to the two first combining portions 44.

The second edge 52 defines a first opening 55. An inner diameter D3 of the first opening 55 is larger than the maximum outer diameter D1 of the impeller 20. As stated in the above, the impeller 20 is mounted on the base 402 of the first body 40 firstly, then via the first opening, the second body 50 is mounted around the impeller 20 so as to smoothly assemble the impeller 20 and the second body 50.

In an embodiment, the first combining portion 43 includes a first extending portion 431 extending along the first side wall 41 and the first edge 42. That is, the first extending portion 431 extends along a peripheral direction of the first side wall 41. A first guiding slot 436 is defined between the first extending portion 431 and the first edge 42. The second combining portion 53 includes a limiting protrusion 531 extending along the second side wall 51 and the second edge 52. By appropriate positioning, the second body 50 is disposed on the first body 40, and a force is exerted appropriately to rotate the first body 40 or the second body 50 so that the limiting protrusion 531 is mounted in the first guiding slot 436, and the first extending portion 431 is disposed on the limiting protrusion 531 so as to combine the first body 40 and the second body 50.

The first extending portion 431 includes a first positioning recess 432 formed on the inner wall of the first extending portion 431. The second combining portion 53 further includes a first positioning protrusion 532 formed above the limiting protrusion 531. The disposing place of the first positioning protrusion 532 is corresponding to that of the first positioning recess 432, and the shape of the first positioning protrusion 532 is corresponding to that of the first positioning recess 432. Therefore, after the limiting protrusion 531 is mounted in the first guiding slot 436, the first positioning protrusion 532 is mounted in the first positioning recess 432 to position and combine the first body 40 and the second body 50.

The first extending portion 431 further includes a first positioning hook 433 extending downward. The limiting protrusion 531 includes a second positioning hook 533 extending upward. After the limiting protrusion 531 is mounted in the first guiding slot 436, the first positioning hook 433 is disposed outside of the second positioning hook 533 so that the first positioning hook 433 and the second positioning hook 533 are locked and positioned each other to further position and combine the first body 40 and the second body 50.

The first combining portion 43 further includes a second positioning protrusion 434 disposed on an inner side of the first side wall 41, and extending inward. The second combining portion 53 further includes a second extending portion 534 formed on the second edge 52 and extending downward. The second extending portion 534 includes a second guiding slot 535. The disposing place of the second extending portion 534 is corresponding to that of the second positioning protrusion 434, and the shape of the second positioning protrusion 434 is corresponding to that of the second guiding slot 535. Therefore, when the limiting protrusion 531 is mounted in the first guiding slot 436, on the inner side of the first side wall 41, the second positioning protrusion 434 is mounted in the second guiding slot 535 so as to further position and combine the first body 40 and the second body 50.

Using the above structures of the first combining portion 43 and the second combining portion 53, the first body 40 and the second body 50 can be combined smoothly. After the first body 40 and the second body 50 are assembled, the first body 40 and the second body 50 can be disassembled by an exerted force appropriately to rotate the first body 40 and the second body 50 in a reverse direction. Thus, the first body 40 and the second body 50 can be disassembled, and the structures of the first combining portion 43 and the second combining portion 53 will not be broken.

Figure 4:
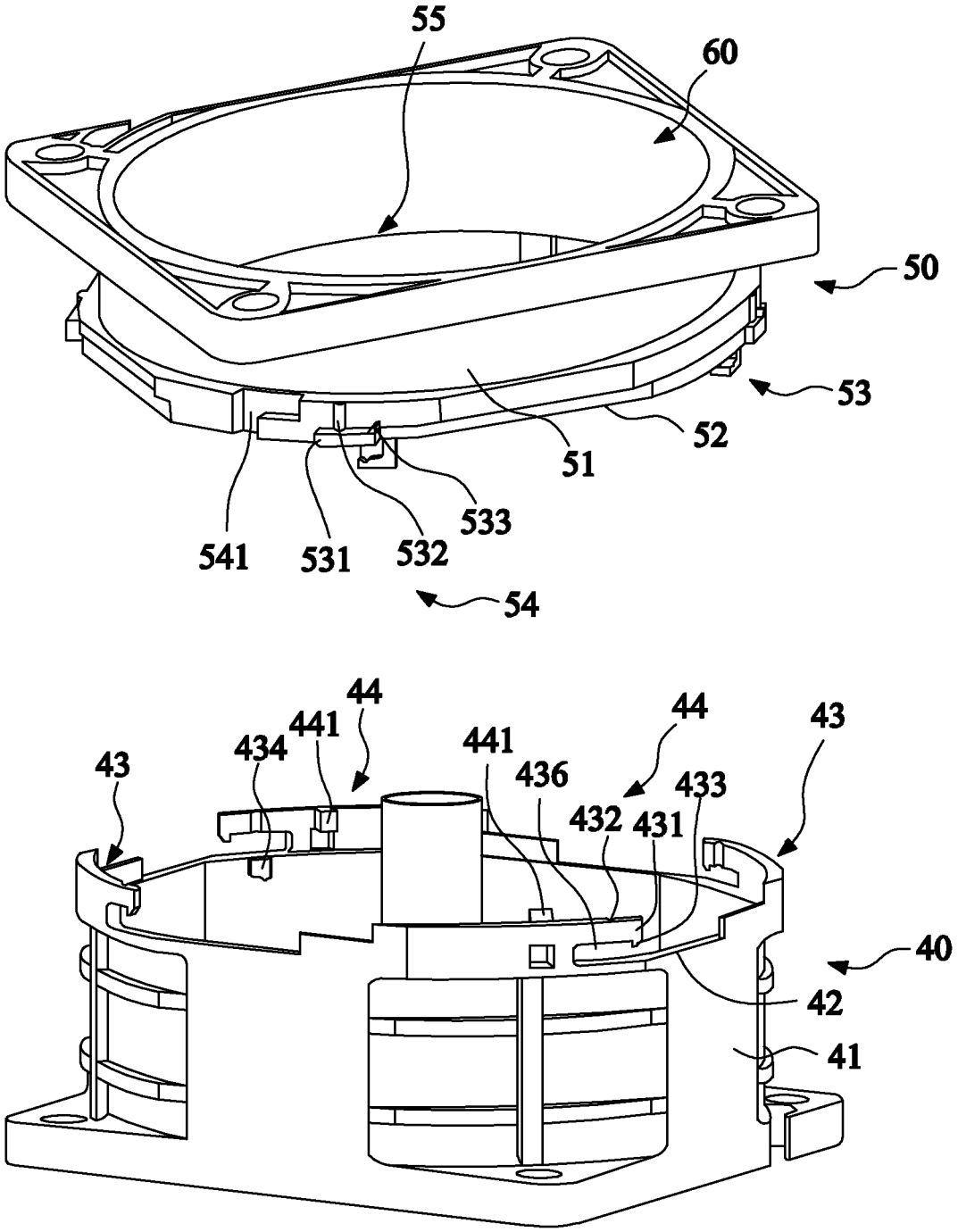
FIG. 4 is an exploded perspective view of a fan frame from a second view angle in accordance with some embodiments.
Figure 5:
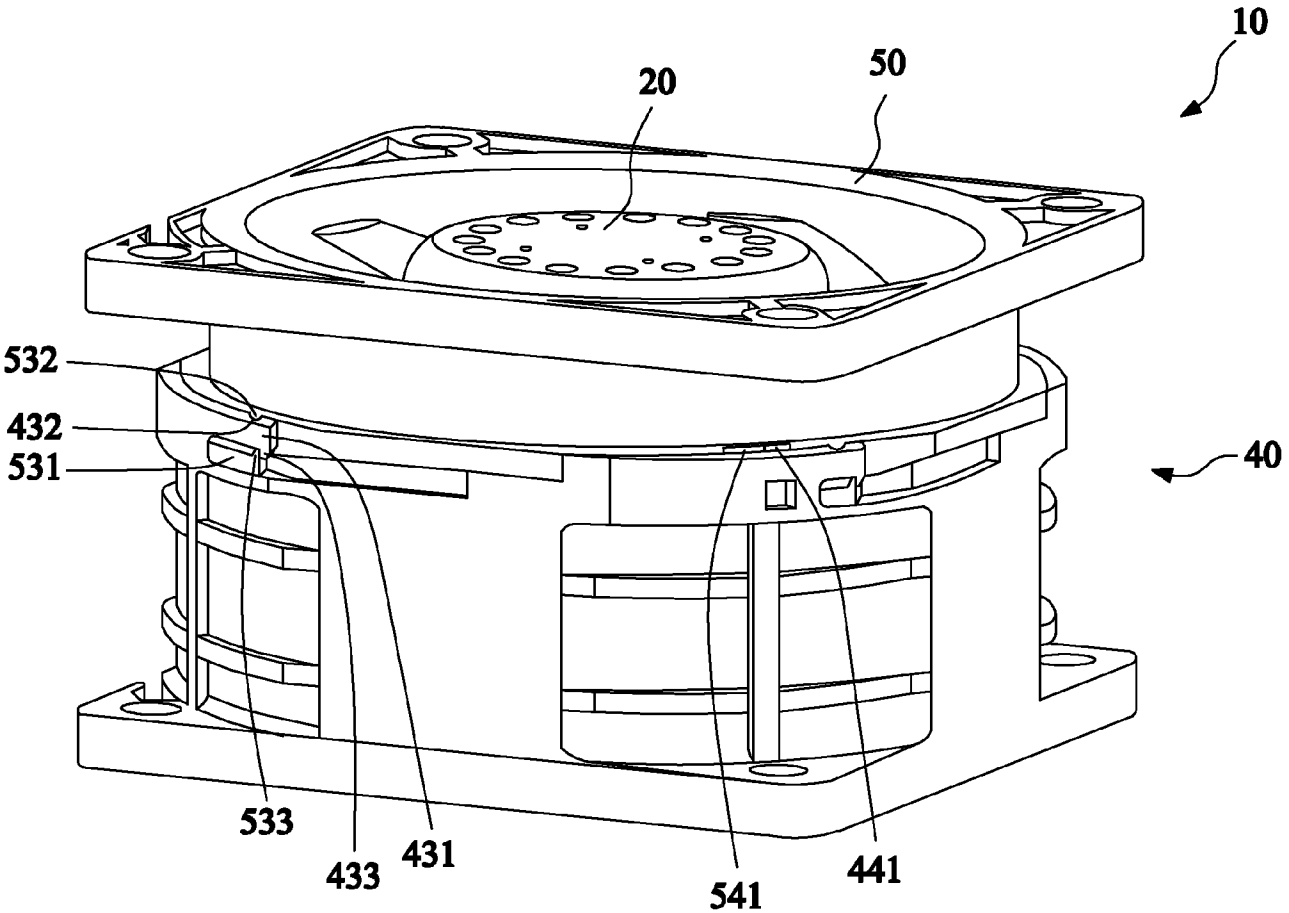
FIG. 5 is a combined perspective view of an axial flow fan from a second view angle in accordance with some embodiments.

Because the structure of the first combining portion 43 is different from that of the first combining portion 44, and the structure of the second combining portion 53 is different from that of the second combining portion 54, the first combining portion 44 and the second combining portion 54 are shown from different view angle. FIG. 4 is an exploded perspective view of a fan frame from a second view angle in accordance with some embodiments. FIG. 5 is a combined perspective view of an axial flow fan from a second view angle in accordance with some embodiments. Referring to FIG. 4 and FIG. 5, with reference to the structures in the first combining portion 43 and the second combining portion 53 shown in FIG. 2 and FIG. 3, similar components in the first combining portion 44 and the second combining portion 54 are labeled with the same component numbers. The first combining portion 44 further includes a third positioning protrusion 441 disposed on an inner side of the first side wall 41, and extending inward. The disposing level of the third positioning protrusion 441 is the same as that of the first extending portion 431. The second combining portion 54 further includes a second positioning recess 541. The second positioning recess 541 includes an inlet and a turning area. After the third positioning protrusion 441 enters into the second positioning recess 541 via the inlet of the second positioning recess 541, a force is exerted appropriately to rotate the first body 40 or the second body 50 so that the third positioning protrusion 441 is mounted in the second positioning recess 541 so as to further position and combine the first body 40 and the second body 50.

Using the structure of the third positioning protrusion 441 and the second positioning recess 541, the first body 40 and the second body 50 can be combined and assembled only from a specific position so as to prevent the mistake during assembling and to improve the assembling efficiency and quality.

While the embodiment of the present invention have been illustrated and described, various modifications and improvements can be made by those skilled in the art. The embodiments of the present invention are therefore described in an illustrative but not restrictive sense. It is intended that the present invention may not be limited to the particular forms as illustrated, and all modifications that maintain the spirit and scope of the present invention are within the scope as defined in the appended claims.

What is claimed is:

1. An axial flow fan, comprising:

an impeller having a maximum outer diameter; and a fan frame comprising a first body and a second body, the first body comprising a plurality of connecting ribs and a base, the connecting ribs connected to the base, the second body being a hollow body for disposing around the impeller, the second body comprising a flow passage having a minimum inner diameter, wherein the minimum inner diameter of the flow passage is not larger than the maximum outer diameter of the impeller;

wherein the impeller is mounted on the base of the first body, the second body comprises a first opening, an inner diameter of the first opening is larger than the maximum outer diameter of the impeller; via the first opening, the second body is mounted around the impeller, and the second body and the first body are combined; the second body is disposed on a side of the first body, and the side of the first body is opposite of the base of the first body;

wherein an inner side of the first body is straight, part of an outside edge of the impeller is mounted in the straight inner side of the first body, and an inner side of the second body is a narrow structure on a top and a wide structure on a bottom, part of the outside edge of the impeller is mounted in the inner side of the second body;

wherein part of the outside edge of the impeller is an axial outside edge, and the axial outside edge of the impeller is corresponding to a flow passage of the first body, the flow passage of the first body is straight corresponding to a shaft of the impeller, and a portion of the flow passage of the first body is parallel to the impeller.

2. The axial flow fan according to claim 1, wherein the first body comprises a first side wall, a first edge and at least one first combining portion, the first edge is formed on the first side wall, the at least one first combining portion is formed on the first edge, and extends along the first side wall and the first edge.

3. The axial flow fan according to claim 2, wherein the second body comprises a second side wall, a second edge and at least one second combining portion, the second edge is formed under the second side wall, the at least one second combining portion is formed on the second edge, and extends along the second side wall and the second edge, a disposing place of the at least one second combining portion is corresponding to that of the at least one first combining portion so as to combine the at least one first combining portion and the at least one second combining portion, the second edge defines the first opening.

4. The axial flow fan according to claim 3, wherein the first combining portion comprises a first extending portion extending along the first side wall and the first edge, a first guiding slot is defined between the first extending portion and the first edge; the second combining portion comprises a limiting protrusion extending along the second side wall and the second edge, the limiting protrusion is mounted in the first guiding slot.

5. The axial flow fan according to claim 4, wherein the first extending portion comprises a first positioning recess, the second combining portion further comprises a first positioning protrusion formed above the limiting protrusion, a disposing place of the first positioning protrusion is corresponding to that of the first positioning recess, the first positioning protrusion is mounted in the first positioning recess.

6. The axial flow fan according to claim 4, wherein the first extending portion further comprises a first positioning hook extending downward, and the limiting protrusion comprises a second positioning hook extending upward, the first positioning hook and the second positioning hook are locked and positioned to each other.

7. The axial flow fan according to claim 3, wherein the first combining portion further comprises a second positioning protrusion disposed on an inner side of the first side wall, and extending inward; the second combining portion further comprises a second extending portion formed on the second edge and extending downward, the second extending portion comprises a second guiding slot, the second positioning protrusion is mounted in the second guiding slot.

8. The axial flow fan according to claim 3, wherein the first combining portion further comprises a third positioning protrusion disposed on an inner side of the first side wall, and extending inward; the second combining portion further comprises a second positioning recess, the third positioning protrusion is mounted in the second positioning recess.

* * * * *